US005701770A

United States Patent [19]

Cook et al.

[11] Patent Number: 5,701,770

[45] Date of Patent: Dec. 30, 1997

[54] GUN SAFE WITH DUAL METHOD OF GAINING ACCESS THEREIN

[76] Inventors: Nancy A. Cook; Anne M. Murray, both of 380 Newport Ave., Long Beach, Calif. 90814

[21] Appl. No.: 792,947

[22] Filed: Jan. 21, 1997

[51] Int. Cl.[6] ..... E05B 65/52

[52] U.S. Cl. ..... 70/63; 70/159; 70/279; 206/1.5; 206/317; 340/825.31; 356/71; 382/124

[58] Field of Search ..... 70/63, 279, 159–162; 340/825.31; 224/912, 913; 206/1.5, 317; 382/124; 356/71

[56] References Cited

U.S. PATENT DOCUMENTS

| | | | |
|---|---|---|---|
| 4,537,484 | 8/1985 | Fowler et al. | 354/62 |
| 4,651,544 | 3/1987 | Hungerford | 70/63 |
| 4,721,205 | 1/1988 | Burt et al. | 206/317 |
| 4,768,021 | 8/1988 | Ferraro | 340/568 |
| 5,111,755 | 5/1992 | Rouse | 109/25 |
| 5,138,468 | 8/1992 | Barbanell | 359/2 |
| 5,153,561 | 10/1992 | Johnson | 361/172 X |
| 5,161,396 | 11/1992 | Loeff | 70/63 |
| 5,168,994 | 12/1992 | Beletsky et al. | 206/317 |
| 5,245,329 | 9/1993 | Gokcebay | 70/409 X |
| 5,579,909 | 12/1996 | Deal | 206/317 |

*Primary Examiner*—Lloyd A. Gall

[57] ABSTRACT

A gun safe with dual method of gaining access therein including a portable housing having a top face, a bottom face, a pair of side faces and a pair of end faces formed therebetween thereby defining an interior space. One of the end faces is hingably coupled for allowing it to be pivoted between an open orientation and a closed orientation. Also included is a solenoidal locking mechanism situated within the interior space of the gun safe on the top face thereof. Such solenoidal locking mechanism is further situated adjacent an upper end of the hingably coupled end face. Further provided is a fingerprint scanning mechanism positioned within the interior space of the gun safe. The fingerprint scanning mechanism is adapted to detect the placement of a fingerprint adjacent thereto whereat the scanning mechanism is adapted to scan the fingerprint and convert the same into a digital format for processing. Memory is included within the interior space of the gun safe for storing a fingerprint of at least one predetermined authorized user in a digital format. Lastly, a verification mechanism is situated within the interior space of the housing and connected to the locking mechanism, memory, and the fingerprint scanning mechanism. The verification mechanism is adapted to transmit the unlock signal to the locking mechanism upon the matching of a scanned fingerprint with at least one of the fingerprints stored in the memory.

6 Claims, 3 Drawing Sheets

FIG. 3
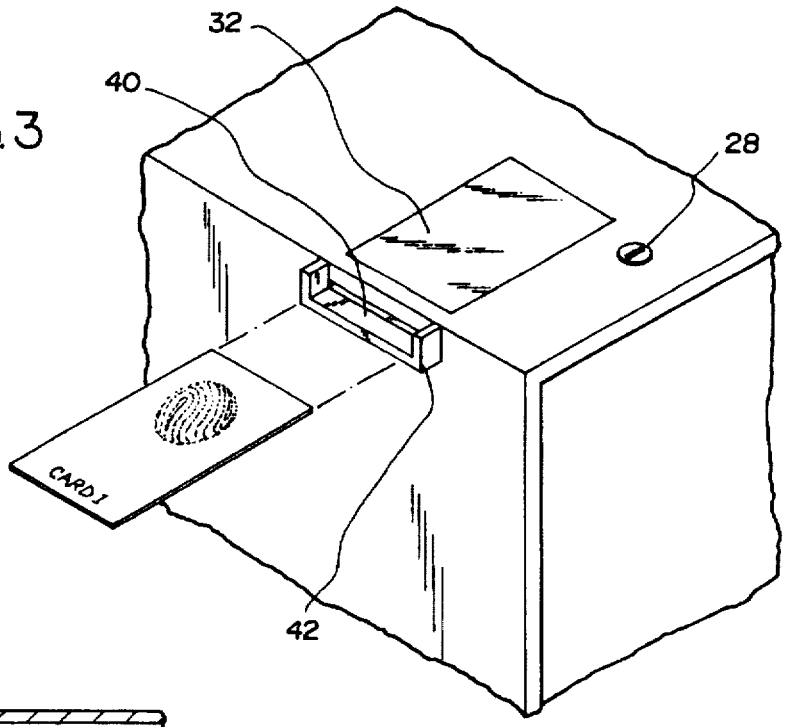
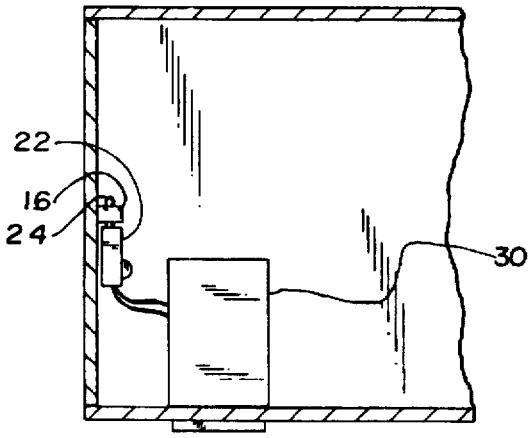
FIG. 4
FIG. 5
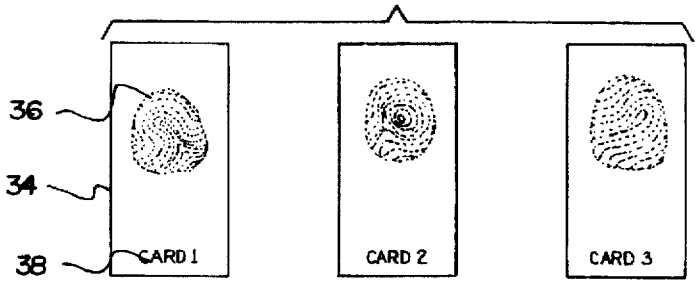

GUN SAFE WITH DUAL METHOD OF GAINING ACCESS THEREIN

BACKGROUND OF THE INVENTION

1. Field of the Invention

The present invention relates to a gun safe with dual method of gaining access therein and more particularly pertains to allowing access to a gun located within a portable safe only after verifying a fingerprint of a user attempting to gain access therein.

2. Description of the Prior Art

The use of gun locking devices is known in the prior art. More specifically, gun locking devices heretofore devised and utilized for the purpose of precluding unauthorized access to a gun are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,138,468 to Barbanell; U.S. Pat. No. 5,111,755 to Rouse; U.S. Pat. No. 5,168,994 to Beletsky et al.; U.S. Pat. No. 5,245,329 to Gokcebay; U.S. Pat. No. 4,768,021 to Ferraro; and U.S. Pat. No. 4,721,205 to Burt et al.

In this respect, the gun safe with dual method of gaining access therein according to the present invention substantially departs from the conventional concepts and designs of the prior art, and in so doing provides an apparatus primarily developed for the purpose of allowing access to a gun located within a safe only after verifying a fingerprint of a user attempting to gain access therein.

Therefore, it can be appreciated that there exists a continuing need for a new and improved gun safe with dual method of gaining access therein which can be used for allowing access to a gun located within a safe only after verifying a fingerprint of a user attempting to gain access therein. In this regard, the present invention substantially fulfills this need.

SUMMARY OF THE INVENTION

In view of the foregoing disadvantages inherent in the known types of gun locking devices now present in the prior art, the present invention provides an improved gun safe with dual method of gaining access therein. As such, the general purpose of the present invention, which will be described subsequently in greater detail, is to provide a new and improved gun safe with dual method of gaining access therein which has all the advantages of the prior art and none of the disadvantages.

To attain this, the present invention essentially comprises a portable gun safe with a rectangular configuration. As shown in FIGS. 1&2, the gun safe has a top face, a bottom face, a pair of side faces and a pair of end faces formed therebetween thereby defining an interior space. One of the end faces is hingably coupled at a lower end thereof to the bottom face for allowing it to be pivoted between an open orientation and a closed orientation. For allowing convenient transporting of the gun safe, a handle is included having a generally U-shaped configuration with a pair of ends hingably coupled to a central extent of the top face for carrying purposes. As best shown in FIGS. 2 & 4, a solenoidal locking mechanism is situated within the interior space of the gun safe on the top face thereof adjacent an upper end of the hingably coupled end face. The solenoidal locking mechanism has a pin which is removably situated within an aperture of a tab formed in the upper end of the hingably coupled end face. In use, the pin has a first orientation inserted within the aperture of the tab when the locking mechanism is not in receipt of an unlock signal for precluding access within the interior space of the gun safe. For allowing access within the interior space of the gun safe, the pin has a second orientation removed from the aperture of the tab when the locking mechanism is in receipt of the unlock signal. For allowing the solenoid locking mechanism to be manually overridden, a key mechanism is situated exterior of the gun safe on the top face thereof. The key mechanism is adapted to allow the insertion of a key therein for allowing a user to manually transfer the pin of the locking mechanism from the first orientation to the second orientation thereof. Further provided is a fingerprint scanning means positioned within the interior space of the gun safe. The fingerprint scanning means is adapted to detect the placement of a fingerprint adjacent thereto whereat the scanning means is adapted to scan the fingerprint. Upon being scanned, the fingerprint is converted into a digital format for processing. To allow a fingerprint to be scanned directly from a finger of a user, the fingerprint scanning means further includes a transparent panel. The transparent panel is situated on the top face of the gun safe adjacent a side face thereof for allowing the temporary placement of a fingerprint of a user thereon to be scanned by the fingerprint scanning means upon the detection thereof. Associated with the fingerprint scanning means are a plurality of cards. Each card has a rectangular configuration having a top face and a bottom face. The bottom face of each card has a fingerprint of a predetermined authorized user printed pictorially thereon. To allow a fingerprint to be scanned from one of the cards, the fingerprint scanning means is provided with a slot formed in the side face of the gun safe adjacent the transparent panel. The slot is adapted to allow the insertion of one of the cards therein for being scanned by the fingerprint scanning means upon the detection thereof. Also included is memory means situated within the interior space of the gun safe. The memory means is adapted for storing a fingerprint of at least one predetermined authorized user in a digital format. Finally, verification means is situated within the interior space of the housing and connected to the locking mechanism, memory means, and the fingerprint scanning means. In operation, the verification means is adapted to transmit the unlock signal to the locking mechanism upon the matching of a scanned fingerprint with at least one of the fingerprints stored in the memory means.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved gun safe with dual method of gaining access therein which has all the advantages of the prior art gun locking devices and none of the disadvantages.

It is another object of the present invention to provide a new and improved gun safe with dual method of gaining access therein which may be easily and efficiently manufactured and marketed.

It is a further object of the present invention to provide a new and improved gun safe with dual method of gaining access therein which is of a durable and reliable construction.

An even further object of the present invention is to provide a new and improved gun safe with dual method of gaining access therein which is susceptible of a low cost of manufacture with regard to both materials and labor, and which accordingly is then susceptible of low prices of sale to the consuming public, thereby making such gun safe with dual method of gaining access therein economically available to the buying public.

Still yet another object of the present invention is to provide a new and improved gun safe with dual method of gaining access therein which provides in the apparatuses and methods of the prior art some of the advantages thereof, while simultaneously overcoming some of the disadvantages normally associated therewith.

Still another object of the present invention is to allow access to a gun located within a safe only after verifying a fingerprint of a user attempting to gain access therein.

Lastly, it is an object of the present invention to provide a new and improved gun safe with dual method of gaining access therein including a portable housing having a top face, a bottom face, a pair of side faces and a pair of end faces formed therebetween thereby defining an interior space. One of the end faces is hingably coupled for allowing it to be pivoted between an open orientation and a closed orientation. Also included is a solenoidal locking mechanism situated within the interior space of the gun safe on the top face thereof. Such solenoidal locking mechanism is further situated adjacent an upper end of the hingably coupled end face. The solenoidal locking mechanism has a first normal orientation for precluding access within the interior space of the gun safe and further having a second orientation for allowing access therein upon the receipt of an unlock signal. Further provided is a fingerprint scanning mechanism positioned within the interior space of the gun safe. The fingerprint scanning mechanism is adapted to detect the placement of a fingerprint adjacent thereto whereat the scanning mechanism is adapted to scan the fingerprint and convert the same into a digital format for processing. Memory is included within the interior space of the gun safe for storing a fingerprint of at least one predetermined authorized user in a digital format. Lastly, a verification mechanism is situated within the interior space of the housing and connected to the locking mechanism, memory, and the fingerprint scanning mechanism. The verification mechanism is adapted to transmit the unlock signal to the locking mechanism upon the matching of a scanned fingerprint with at least one of the fingerprints stored in the memory.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a perspective view of the fingerprint scanning means of the present invention.

FIG. 4 is a cross-sectional view taken along line 4—4 shown in FIG. 1 showing the fingerprint scanning means and locking mechanism.

FIG. 5 is a plan view of the cards of the present invention.

Similar reference characters refer to similar parts throughout the several views of the drawings.

DESCRIPTION OF THE PREFERRED EMBODIMENT

Figure 1:
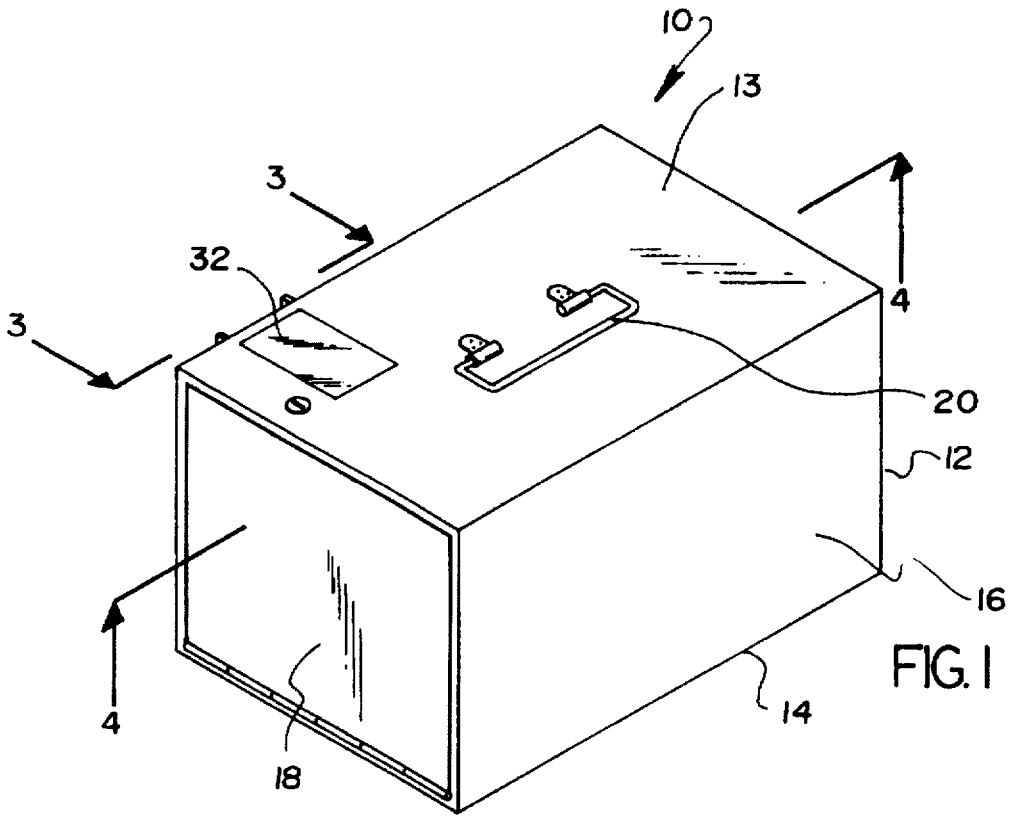
FIG. 1 is a perspective illustration of the preferred embodiment of the gun safe with dual method of gaining access therein constructed in accordance with the principles of the present invention.

With reference now to the drawings, and in particular to FIG. 1 thereof, a new and improved gun safe with dual method of gaining access therein embodying the principles and concepts of the present invention and generally designated by the reference numeral 10 will be described.

The present invention, the new and improved gun safe with dual method of gaining access therein, is comprised of a plurality of components. Such components in their broadest context include a gun safe, a locking mechanism, fingerprint scanning means, memory means and verification means. Such components are individually configured and correlated with respect to each other so as to attain the desired objective.

Figure 2:
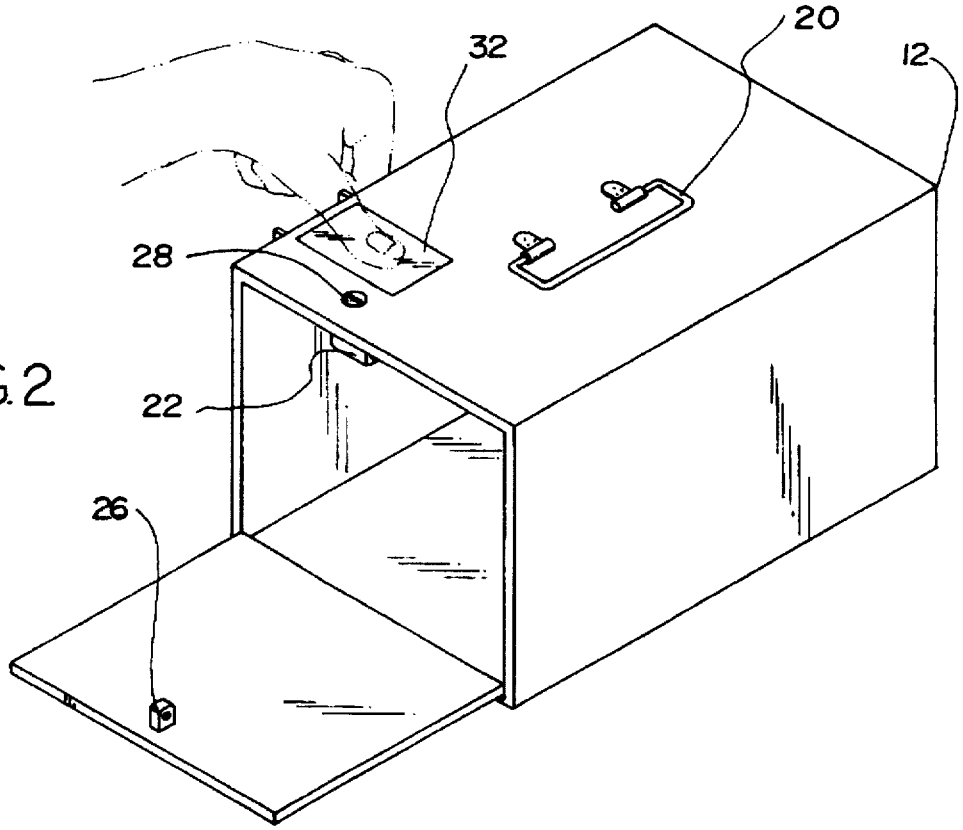
FIG. 2 is a perspective illustration of the present invention with one of the end faces thereof in an open orientation.

More specifically, it will be noted that the system 10 of the present invention includes a portable gun safe 12 with a rectangular configuration. As shown in FIGS. 1&2, the gun safe has a top face 13, a bottom face 14, a pair of side faces 16 and a pair of end faces 18 formed therebetween thereby defining an interior space. One of the end faces is hingably coupled at a lower end thereof to the bottom face for allowing it to be pivoted between an open orientation and a closed orientation. For allowing convenient transporting of the gun safe, a handle 20 is included having a generally U-shaped configuration with a pair of ends hingably coupled to a central extent of the top face of the gun safe for carrying purposes.

As best shown in FIGS. 2 & 4, a solenoidal locking mechanism 22 is situated within the interior space of the gun safe on the top face thereof. Such locking mechanism is further positioned adjacent an upper end of the hingably coupled end face. The solenoidal locking mechanism has a pin 24 which is removably situated within an aperture of a tab 26 formed in the upper end of the hingably coupled end face. In use, the pin has a first orientation inserted within the aperture of the tab when the locking mechanism is not in receipt of an unlock signal for precluding access within the interior space of the gun safe. For allowing access within the interior space of the gun safe, the pin has a second orientation removed from the aperture of the tab when the locking mechanism is in receipt of the unlock signal.

For allowing the solenoid locking mechanism to be manually overridden, a key mechanism 28 is situated exterior of the gun safe on the top face thereof. The key mechanism is adapted to allow the insertion of a key therein for allowing a user to manually transfer the pin of the locking mechanism from the first orientation to the second orientation thereof.

Further provided is a fingerprint scanning means 30 positioned within the interior space of the gun safe. The fingerprint scanning means is adapted to detect the placement of a fingerprint adjacent thereto whereat the scanning means is adapted to scan the fingerprint. Upon being scanned, the fingerprint is converted into a digital format for processing. Apparatuses for scanning a fingerprint and thereafter converting it for processing are known in the prior art. For further details regarding the construction of such apparatuses, reference may be made to U.S. Pat. No. 5,138,468 to Barbanell and U.S. Pat. No. 4,537,484 to Fowler.

To allow a fingerprint to be scanned directly from a finger of a user, the fingerprint scanning means further includes a transparent panel 32. The transparent panel is situated on the top face of the gun safe adjacent a side face thereof for allowing the temporary placement of a fingerprint of a user thereon to be scanned by the fingerprint scanning means upon the detection thereof.

Associated with the fingerprint scanning means are a plurality of cards 34. Each card has a rectangular configuration with a top face and a bottom face. The bottom face of each card has a fingerprint 36 of a predetermined authorized user printed pictorially thereon. Ideally, each card is equipped with indicia 38 printed thereon for identification purposes. It should be noted that the cards are suitably constructed of plastic and may be carried in a wallet in a manner similar to that of a credit card.

To allow a fingerprint to be scanned from one of the cards, the fingerprint scanning means is provided with a slot 40 formed in the side face of the gun safe adjacent the transparent panel. The slot is adapted to allow the insertion of one of the cards therein for being scanned by the fingerprint scanning means upon the detection thereof. To aid the insertion of a card within the slot, a lip 42 surrounds the lower and side edges of the slot, as shown in FIG. 3.

Also included is memory means 44 situated within the interior space of the gun safe. The memory means is adapted for storing a fingerprint of at least one predetermined authorized user in a digital format. Ideally, the memory means includes a standard EEPROM 46 in which a fingerprint of an authorizer user may be stored. A keypad 48 may be included within the interior space of the gun safe for facilitating the programming of the EEPROM prior to use of the present invention.

Figure 7:
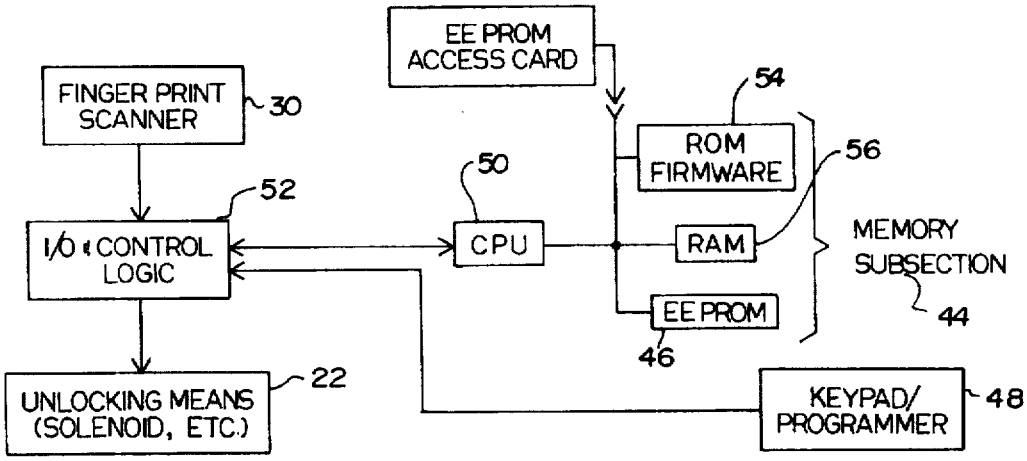
FIG. 7 is a schematic diagram depicting the various electrical components of the present invention.

Finally, verification means 50 is situated within the interior space of the housing and connected to the locking mechanism, memory means, and the fingerprint scanning means. In operation, the verification means is adapted to transmit the unlock signal to the locking mechanism upon the matching of a scanned fingerprint with at least one of the fingerprints stored in the memory means. As shown in FIG. 7, the verification means preferably takes the form of a central processing unit(CPU). The CPU utilizes conventional control logic 52 to interface with the scanning means and locking mechanism. Basically, in use, the CPU is adapted to receive instructions from associated read-only memory(ROM) 54 to store a recently scanned fingerprint in random access memory(RAM) 56. At this point, such instructions govern the CPU in comparing the fingerprint temporarily stored in the RAM with those stored in the EEPROM. Upon a match occurring, the control logic is utilized to deploy an unlock signal to the fingerprint scanning means.

Figure 6:
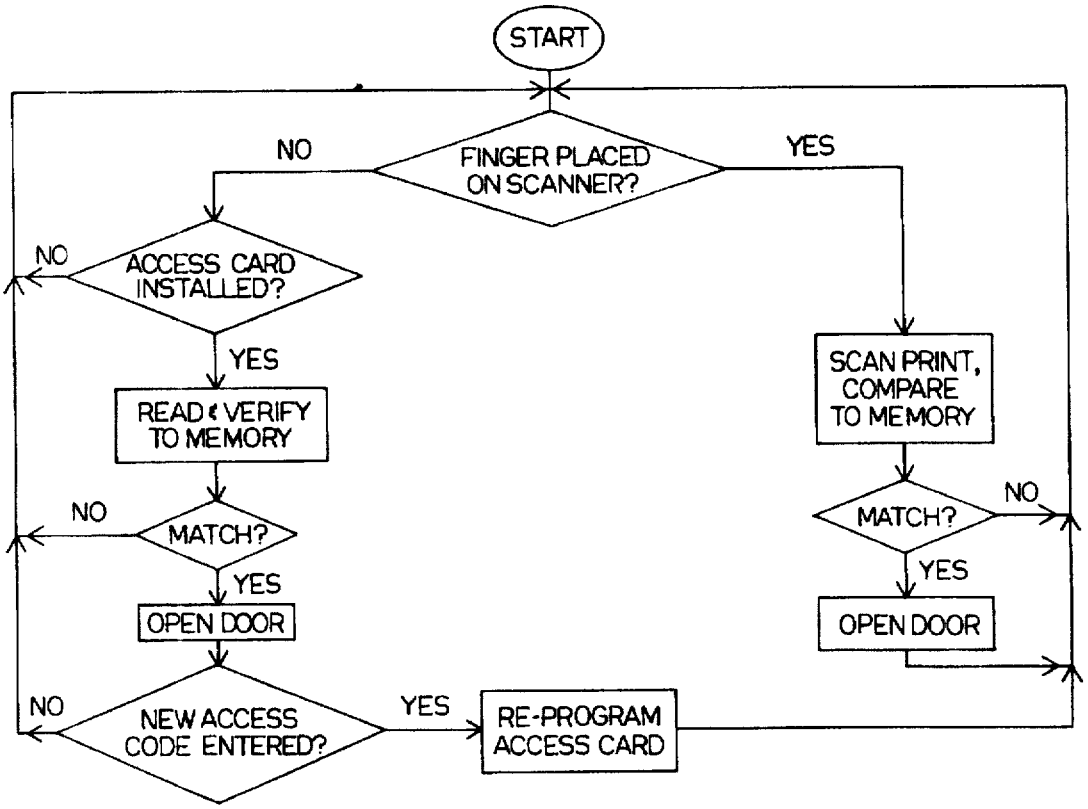
FIG. 6 is a flow chart illustrating the method associated with the present invention.

The method that is associated with the present invention is illustrated in FIG. 6. As can be seen, the present invention is activated by the detection of either a card inserted within the slot or a finger placed on the transparent panel. At this point, the fingerprint is scanned and compared with those stored in the EEPROM. Upon ascertaining a match, the end face of the gun safe is opened thereby allowing an authorized user access to a gun stored therein. When the door is open, an access code may be entered via the keypad and additional fingerprints may be scanned and stored in the EEPROM. Such keypad may also be utilized to delete fingerprints stored in the EEPROM.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved gun safe with dual method of gaining access therein comprising, in combination:

a portable gun safe with a rectangular configuration having a top face, a bottom face, a pair of side faces and a pair of end faces formed therebetween thereby defining an interior space, one of the end faces being hingably coupled at a lower end thereof to the bottom face for allowing it to be pivoted between an open orientation and a closed orientation, the gun safe further including a handle having a generally U-shaped configuration with a pair of ends hingably coupled to a central extent of the top face for carrying purposes;

a solenoidal locking mechanism situated within the interior space of the gun safe on the top face thereof adjacent an upper end of the hingably coupled end face, the solenoidal locking mechanism having a pin which is removably situated within an aperture of a tab formed in the upper end of the hingably coupled end face, the pin having a first orientation inserted within the aperture of the tab when the locking mechanism is not in receipt of an unlock signal for precluding access within the interior space of the gun safe and further having a second orientation removed from the aperture of the tab when the locking mechanism is in receipt of the unlock signal for allowing access within the interior space of the gun safe;

said locking mechanism further having a key mechanism situated exterior of the gun safe on the top face thereof, the key mechanism adapted to allow the insertion therein of a key for allowing a user to manually transfer the pin of the locking mechanism from the first orientation to the second orientation thereof;

fingerprint scanning means positioned within the interior space of the gun safe adapted to detect the placement of a fingerprint adjacent thereto whereat the scanning means is adapted to scan the fingerprint and convert the same into a digital format for processing;

said fingerprint scanning means further including a transparent panel situated on the top face of the gun safe adjacent a side face thereof for allowing the temporary placement of a fingerprint of a user thereon to be scanned by the fingerprint scanning means upon the detection thereof;

a plurality of cards each with a rectangular configuration having a top face and a bottom face, the bottom face of each card having a fingerprint of a predetermined authorized user printed pictorially thereon;

said fingerprint scanning means further including a slot formed in a side face of the gun safe adjacent the transparent panel, the slot adapted to allow the insertion of one of the cards therein for being scanned by the fingerprint scanning means upon the detection thereof;

memory means situated within the interior space of the gun safe for storing a fingerprint of at least one predetermined authorized user in a digital format; and verification means situated within the interior space of the safe and connected to the locking mechanism, memory means, and the fingerprint scanning means, the verification means adapted to transmit the unlock signal to the locking mechanism upon the matching of a scanned fingerprint with at least one of the fingerprints stored in the memory means.

2. A gun safe comprising:

a portable gun safe with a rectangular configuration having a top face, a bottom face, a pair of side faces and a pair of end faces formed therebetween thereby defining an interior space, one of the end faces being hingably coupled at a lower end thereof to the bottom face for allowing it to be pivoted between an open orientation and a closed orientation;

a solenoidal locking mechanism situated within the interior space of the gun safe on the top face thereof adjacent an upper end of the hingably coupled end face, the solenoidal locking mechanism having a first orientation for precluding access within the interior space of the gun safe and further having a second orientation for allowing access within the interior space of the gun safe;

fingerprint scanning means positioned within the interior space of the gun safe adapted to detect the placement of a fingerprint adjacent thereto whereat the scanning means is adapted to scan the fingerprint and convert the same into a digital format for processing;

memory means situated within the interior space of the gun safe for storing a fingerprint of at least one predetermined authorized user in a digital format; and verification means situated within the interior space of the safe and connected to the locking mechanism, memory means, and the fingerprint scanning means, the verification means adapted to transmit an unlock signal to the locking mechanism upon the matching of a scanned fingerprint with at least one of the fingerprints stored in the memory means; wherein said fingerprint scanning means further includes a slot formed in a side face of the gun safe adjacent a transparent panel, the slot adapted to allow the insertion of cards therein for being scanned by the fingerprint scanning means upon the detection thereof.

3. A gun safe as set forth in claim 2 wherein the gun safe further includes a handle having a generally U-shaped configuration with a pair of ends hingably coupled to a central extent of the top face for carrying purposes.

4. A gun safe as set forth in claim 2 wherein said locking mechanism further has a key mechanism situated exterior of the gun safe on the top face thereof, the key mechanism adapted to allow the insertion therein of a key for allowing a user to manually transfer a pin of the locking mechanism from the first orientation to the second orientation thereof.

5. A gun safe as set forth in claim 2 wherein said fingerprint scanning means further includes a transparent panel situated on the top face of the gun safe adjacent a side face thereof for allowing the temporary placement of a fingerprint of a user thereon to be scanned by the fingerprint scanning means upon the detection thereof.

6. A gun safe as set forth in claim 2 and further including a plurality of cards each with a rectangular configuration having a top face and a bottom face, the bottom face of each card having a fingerprint of a predetermined authorized user printed pictorially thereon.

* * * * *